US007511685B2

(12) United States Patent
Kim et al.

(10) Patent No.: US 7,511,685 B2
(45) Date of Patent: Mar. 31, 2009

(54) METHOD AND APPARATUS FOR DRIVING PLASMA DISPLAY PANEL

(75) Inventors: Hee Jae Kim, Gumi-si (KR); Chang Young Kwon, Pohang-si (KR); Jeong Pil Choi, Suwon-si (KR); Seong Ho Kang, Daegu (KR)

(73) Assignee: LG Electronics Inc., Seoul (KR)

( * ) Notice: Subject to any disclaimer, the term of this patent is extended or adjusted under 35 U.S.C. 154(b) by 514 days.

(21) Appl. No.: 11/022,949

(22) Filed: Dec. 28, 2004

(65) Prior Publication Data

US 2005/0264230 A1 Dec. 1, 2005

(30) Foreign Application Priority Data

Dec. 31, 2003 (KR) ..... 10-2003-0102175

(51) Int. Cl.
*G09G 3/28* (2006.01)

(52) U.S. Cl. ..... 345/60; 345/68; 315/169.4

(58) Field of Classification Search ..... 345/60–68; 315/169.4

See application file for complete search history.

(56) References Cited

U.S. PATENT DOCUMENTS 6,294,875 B1 * 9/2001 Kurata et al. ..... 315/169.4
6,809,708 B2 * 10/2004 Kanazawa et al. ..... 345/68
6,977,632 B2 * 12/2005 Mizobata ..... 345/60
7,196,680 B2 * 3/2007 Park ..... 345/63
2003/0006945 A1 1/2003 Lim et al.
2003/0189533 A1 10/2003 Myoung et al.
2004/0196216 A1 10/2004 Shindo et al.
2004/0233134 A1 11/2004 Shindo et al.

FOREIGN PATENT DOCUMENTS

EP 1022715 A2 7/2000
JP 2002-014652 1/2002
JP 2003-050563 2/2003
JP 2003-076320 3/2003
KR 1020030088391 11/2003

* cited by examiner

*Primary Examiner*—Kevin M Nguyen
(74) *Attorney, Agent, or Firm*—McKenna Long & Aldridge LLP

(57) ABSTRACT

Provided are a method and apparatus for driving a PDP for widening a driving margin and improving contrast. The method for driving a PDP includes a first step of forming wall charges in cells with a set-up discharge using a set-up signal in a first sub-field and erasing the wall charges with a set-down discharge using a first set-down signal to initialize the cells, and a second step of erasing the wall charges with a set-down discharge generated using a second set-down signal different from the first set-down signal in a second sub-field, to initialize the cells. The method and apparatus for driving a PDP uniformly initialize sub-fields to widen the driving margin of PDP and remove a set-up discharge in at least one sub-field to improve the contrast of PDP.

17 Claims, 8 Drawing Sheets

METHOD AND APPARATUS FOR DRIVING PLASMA DISPLAY PANEL

This Nonprovisional application claims priority under 35 U.S.C. § 119(a) on Patent Application No. 10-2003-0102175 filed in Korea on Dec. 31, 2003, the entire contents of which are hereby incorporated by reference.

BACKGROUND OF THE INVENTION

1. Field of the Invention

The present invention relates to a plasma display panel and, more particularly, to a method and apparatus for driving a plasma display panel for widening a driving margin and improving contrast.

2. Description of the Background Art

A plasma display panel (referred to as PDP hereinafter) displays images in such a manner that ultraviolet rays generated when an inert mixed gas such as He+Xe, Ne+Xe, He+Xe+Ne or the like is discharged excite phosphors. The size of the PDP can be easily increased and its thickness can be easily reduced. Furthermore, picture quality of the PDP is improved owing to recent technical development.

Referring to FIG. 1, a conventional three-electrode AC-type surface discharge PDP includes scan electrodes Y1 to Yn, sustain electrodes Z, and address electrodes X1 to Xm intersecting the scan electrodes Y1 to Yn and sustain electrodes Z at right angles. A cell 1 displaying one of red, green and blue is formed at each of the intersections of the scan electrodes Y1 to Yn, sustain electrodes Z and address electrodes X1 to Xm. The scan electrodes Y1 to Yn and sustain electrodes Z are formed on an upper substrate (not shown). The upper substrate includes a dielectric layer and a MgO protecting layer (which are not shown) formed thereon. The address electrodes X1 to Xm are formed on a lower substrate (not shown). The lower substrate includes ribs formed thereon. The ribs prevent optical and electrical interference between horizontally adjacent cells. A phosphor layer is formed on the lower substrate and ribs. Phosphors are excited by ultraviolet rays to emit visible light. A mixed gas such as He+Xe, Ne+Xe, He+Ne+Xe or the like, required for discharge, is injected into a discharge space between the upper and lower substrates.

To realize gray scales of images, the PDP is time-division-driven such that one frame, is split into sub-fields having different numbers of times of emission. Each sub-field is divided into a reset period for initializing the entire screen, an address period for selecting a scan line and selecting cells from the selected scan line, and a sustain period for producing gray scales in response to the number of times of discharge. To display an image in 256 gray scales, for example, one frame (16.67 ms) corresponding to 1/60 seconds is divided into eight sub-fields SF1 to SF8, as shown in FIG. 2. Each of the eight sub-fields SF1 to SF8 is split into the reset period, address period and sustain period, as described above. While the reset periods and address periods of the eight sub-fields are equal, the sustain period and the number of sustain pulses allocated thereto are increased at the rate of $2^n$ (n=0,1,2,3,4, 5,6,7) in the sub-fields.

FIG. 3 shows an example of waveforms of driving signals for driving the PFP. Referring to FIG. 3, a conventional PDP driving method generates a set-up discharge using a ramp-up wave RAMP-up and generates a set-down discharge using a ramp-down wave Ramp-dn in each of sub-fields SFn and SFn+1 to initialize cells.

All scan electrodes Y are simultaneously provided with the ramp-up wave Ramp-up in the reset period of each of the sub-fields SFn and SFn+1. At the same time, the sustain electrodes Z and address electrodes X are provided with OV. The ramp-up wave Ramp-up generates the set-up discharge, which barely generates light between adjacent scan electrode Y and address electrode X and between adjacent scan electrode Y and sustain electrode Z in the cells of the entire screen. Due to this set-up discharge, positive wall charges are accumulated on the address electrodes X and sustain electrodes Z and negative wall charges are accumulated on the scan electrodes Y.

The ramp-down wave Ramp-dn following the ramp-up wave Ramp-up is simultaneously provided to the scan electrodes Y. The ramp-down wave Ramp-dn starts to decrease at a sustain voltage Vs lower than a set-up voltage Vsetup of the ramp-up wave Ramp-up and reaches a specific negative voltage. At the same time, the sustain electrodes Z are provided with a first Z bias voltage Vz1 and the address electrodes X are provided with 0V. The first Z bias voltage Vz1 can be set to the sustain voltage Vs. When the ramp-down wave Ramp-dn is provided, a set-down discharge occurs between adjacent scan electrode Y and sustain electrode Z. This set-down discharge erases wall charges unnecessary for an address discharge, among the wall charges generated during the set-up discharge.

In the address period of each of the sub-fields SFn and SFn+1, a scan pulse Scp having a negative write voltage Vw is sequentially provided to the scan electrodes Y and, simultaneously, a data pulse Dp having a positive data voltage Vd, which is synchronized with the scan pulse Scp, is supplied to the address electrodes X. The scan pulse Scp swings between a positive write voltage +Vw lower than the sustain voltage Vs and the negative write voltage Vw. The voltages of the scan pulse Scp and data pulse Dp are added to a wall voltage generated during the reset period to generate an address discharge in the cells provided with the data pulse Dp. During the address period, a second Z bias voltage Vz2 lower than the first Z bias voltage Vz1 is provided to the sustain electrodes Z.

In the sustain period of each sub field SFn and SFn+1, a sustain pulse Susp at the sustain voltage Vs is alternately provided to the scan electrodes Y and sustain electrodes Z. In the cells selected by the address discharge, the wall voltage of the cells is added to the sustain voltage Vs to generate a display discharge between adjacent scan electrode Y and sustain electrode Z whenever the sustain pulse Susp is provided. The sustain period and the number of sustain pulses can be varied with a luminance weight given to the corresponding sub-field.

After the sustain discharge, an erase signal for erasing charges left in the cells can be provided to the scan electrodes Y or sustain electrodes Z.

When the set-down discharge is finished, the set-down voltage of the ramp-down wave Ramp-dn is fixed to a potential, which is higher than the negative write voltage Vw of the scan pulse Scp by ΔV. The lamp-down wave Ramp-dn reduces positive wall charges excessively accumulated on the address electrodes X according to the set-up discharge. Thus, when the set-down voltage of the lamp-down wave Ramp-dn is fixed to the potential higher than the negative write voltage Vw, more positive wall charges can be left on the address electrodes X. Consequently, the driving waveforms of FIG. 3 can reduce the voltages Vd and Vw required for the address discharge to drive the PDP at a low voltage. The voltage applied to the sustain electrodes Z during the address period is reduced to Vz2 in order to compensate the quantity of positive wall charges excessively left on the sustain electrodes Z when the set-down voltage is increased by δV during the set-down discharge.

FIG. 4 shows another example of waveforms of driving signals for driving the PFP. Referring to FIG. 4, the nth sub-field SFn initializes cells of the PDP according to a set-up discharge and set-down discharge while the (n+1)th sub-field SFn+1 initializes cells according to the set-down discharge without using the set-up discharge. The address period and sustain period of each of the nth and (n+1)th sub-fields SFn and SFn+1 are substantially identical to those of FIG. 3.

In the reset period of the nth sub-field SFn, a set-up discharge is generated using the ramp-up wave Ramp-up and then a set-down discharge is generated using the ramp-down wave Ramp-dn to initialize the cells. On the contrary, in the reset period of the (n+1)th sub-field, the lamp-down wave Ramp-dn connected to the last sustain pulse of the scan electrodes Y is applied to the scan electrodes Y to initialize the cells. In the (n+1)th sub-field, a set-down discharge occurs after a sustain discharge without having the set-up discharge, differently from the nth sub-field SFn. Accordingly, the initial state of the nth sub-field SFn before addressing is different from the initial state of the (n+1)th sub-field before addressing and thus a driving margin of the PDP is narrow.

In the meantime, the waveforms of the driving signals shown in FIG. 4 can reduce an increase in a black luminance level, caused by a set-up discharge, because the set-up discharge does not occur in the (n+1)th sub-field. This improves the contrast of PDP.

SUMMARY OF THE INVENTION

Accordingly, an object of the present invention is to solve at least the problems and disadvantages of the background art.

An object of the present invention is to provide a method and apparatus for driving a PDP, which divides one frame into at least one sub-field where a set-up discharge occurs and at least one sub-field where the set-up discharge does not occur to display images, thereby widening the driving margin and improving contrast.

The method for driving a PDP includes a first step of forming wall charges in cells with a set-up discharge using a set-up signal in a first sub-field and erasing the wall charges with a set-down discharge using a first set-down signal to initialize the cells, and a second step of erasing the wall charges with a set-down discharge generated using a second set-down signal different from the first set-down signal in a second sub-field, to initialize the cells.

The apparatus for driving a PDP includes a first initialization driver for forming wall charges in cells with a set-up discharge using a set-up signal in a first sub-field and erasing the wall charges with a set-down discharge using a first set-down signal to initialize the cells, and a second initialization driver for erasing the wall charges with a set-down discharge generated using a second set-down signal different from the first set-down signal in a second sub-field, to initialize the cells.

The method and apparatus for driving a PDP according to the present invention divide one frame into at least one sub-field where a set-up discharge occurs and at least one sub-field where the set-up discharge does not occur to display images. The present invention uniformly initializes the sub-fields to widen the driving margin of PDP and removes a set-up discharge in at least one sub-field to improve the contrast of PDP.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF PREFERRED EMBODIMENTS

Figure 1:
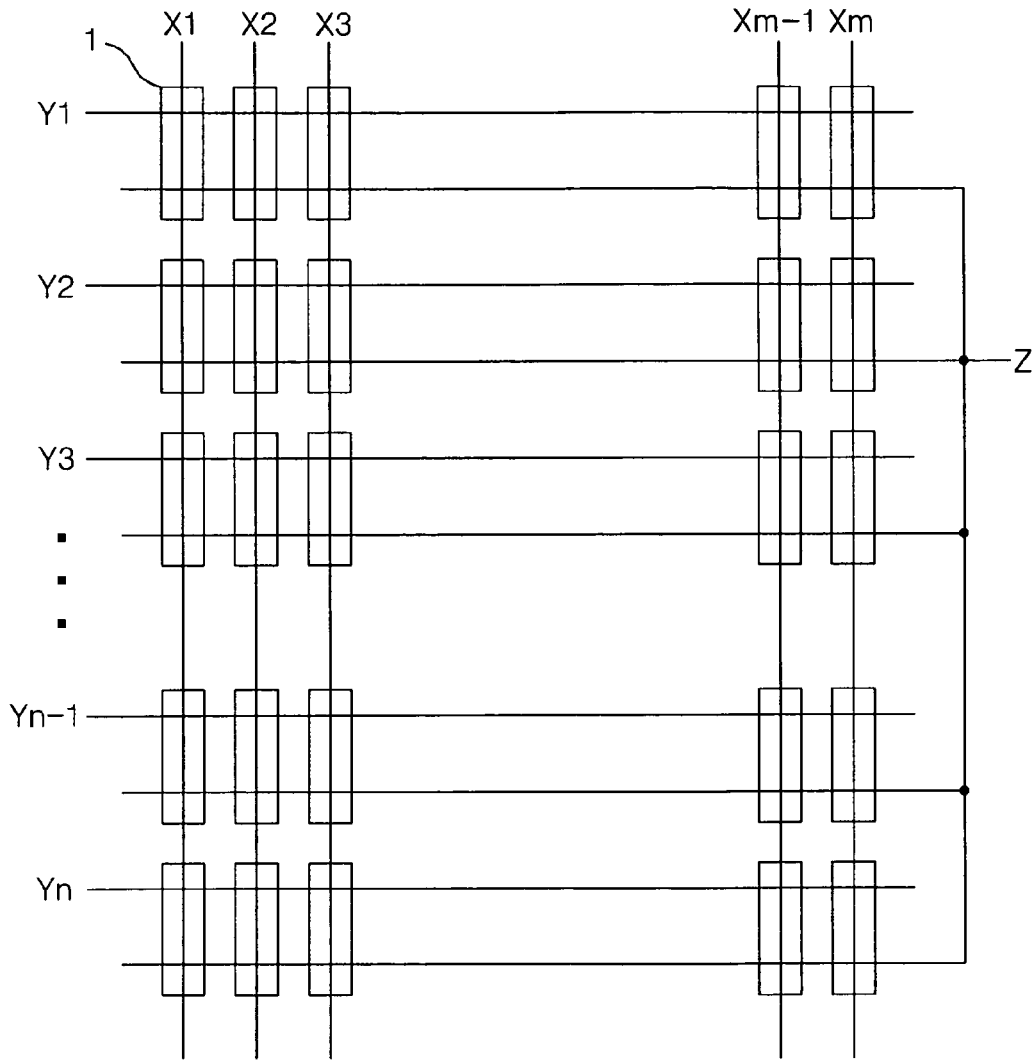
Fig 1. Related Art
FIG. 1 illustrates the arrangement of electrodes of a conventional three-electrode AC-type surface discharge PDP.
Figure 2:
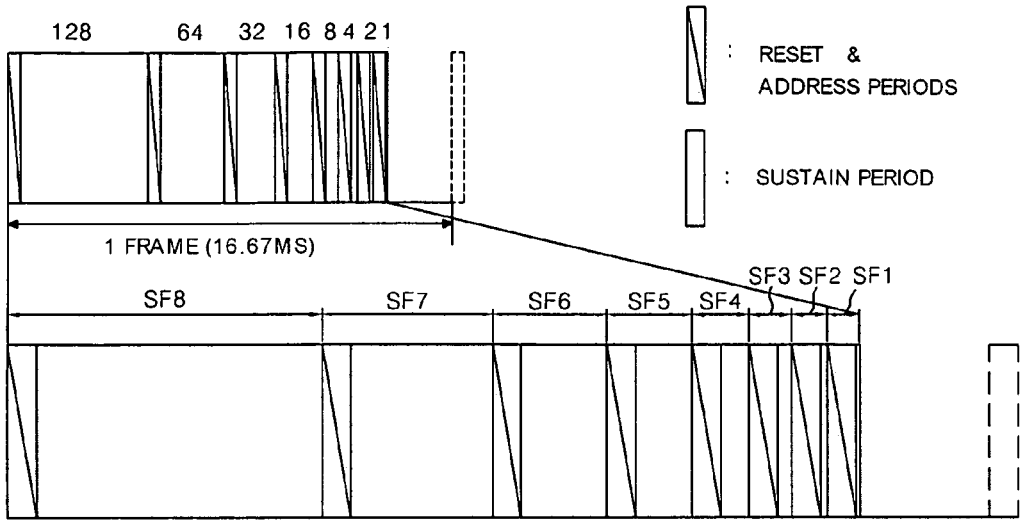
Fig 2. Related Art
FIG. 2 illustrates the composition of a frame of an 8-bit default code for representing 256 gray scales.
Figure 3:
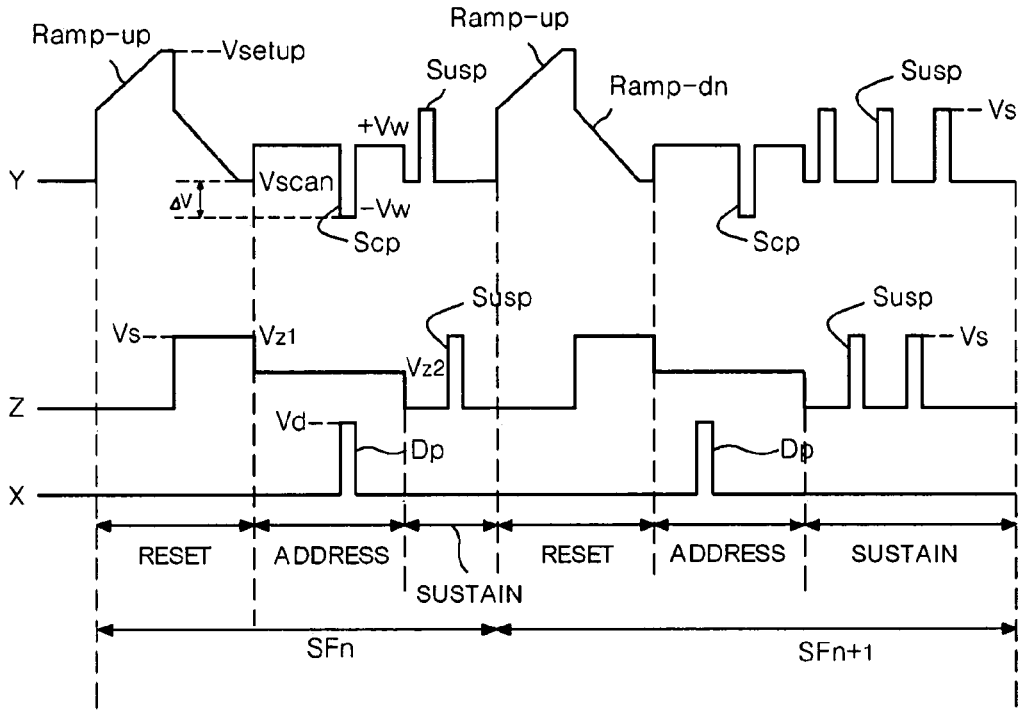
Fig 3. Related Art
FIGS. 3 and 4 show waveforms of driving signals for driving a conventional PDP.
Figure 4:
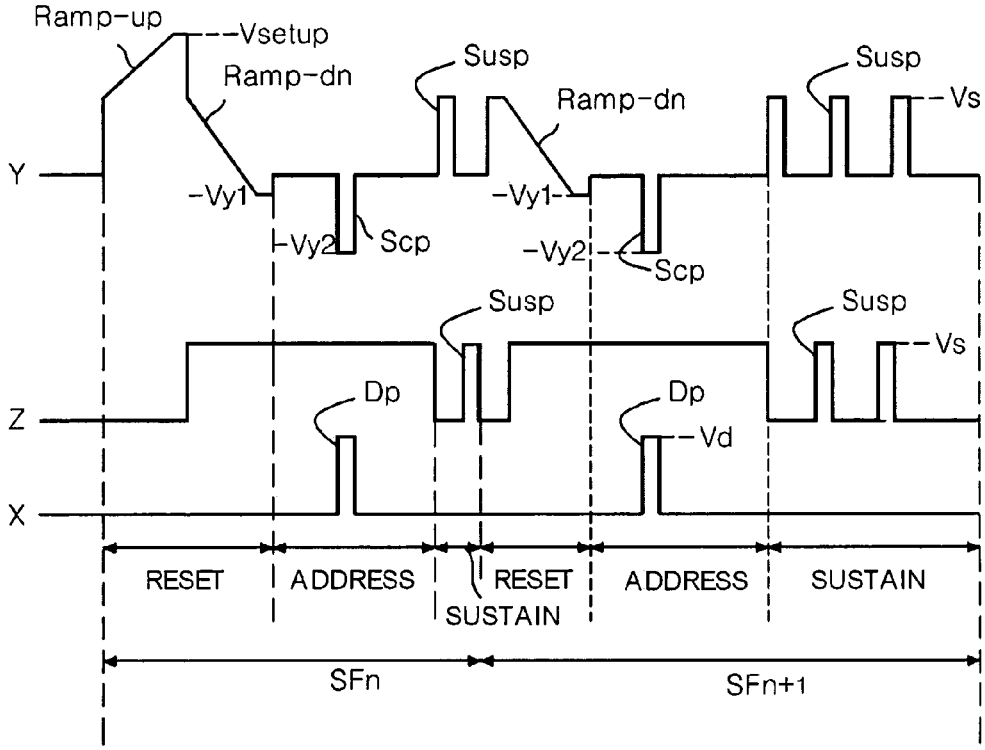
Fig 4. Related Art

Reference will now be made in detail to the preferred embodiments of the present invention, examples of which are illustrated in the accompanying drawings.

A method for driving a PDP according to an embodiment of the present invention includes a first step of forming wall charges in cells with a set-up discharge using a set-up signal in a first sub-field and erasing the wall charges with a set-down discharge using a first set-down signal to initialize the cells, and a second step of erasing the wall charges with a set-down discharge generated using a second set-down signal different from the first set-down signal in a second sub-field, to initialize the cells.

The first and second set-down signals have a ramp waveform whose voltage is gradually decreased.

The absolute value of the lowest voltage of the second set-down signal is higher than the absolute value of the lowest voltage of the first set-down signal.

The gradient of the second set-down signal is larger than that of the first set-down signal.

The first step provides the set-up signal and the first set-down signal to scan electrodes during a reset period of the first sub-field.

The second step provides the second set-down signal to the scan electrodes during a reset period of the second sub-field.

The method for driving a PDP further includes the steps of providing a scan voltage to the scan electrodes and, simultaneously, supplying a data voltage to address electrodes during an address period of the first sub-field, alternately providing a sustain voltage to the scan electrodes and sustain electrodes during a sustain period of the first sub-field, providing the scan voltage to the scan electrodes and, simultaneously, supplying the data voltage to the address electrodes during an address period of the second sub-field, and alternately providing the sustain voltage to the scan electrodes and sustain electrodes during a sustain period of the second sub-field.

The method for driving a PDP further includes the steps of providing a first bias voltage to the sustain electrodes while the first set-down signal is supplied to the scan electrodes in the first sub-field, supplying a second bias voltage lower than the first bias voltage to the sustain electrodes during the address period of the first sub-field, providing a third bias voltage lower than the first bias voltage to the sustain electrodes while the second set-down signal is supplied to the scan electrodes in the second sub-field, and supplying a fourth bias voltage higher than the second bias voltage to the sustain electrodes during the address period of the second sub-field.

The apparatus for driving a PDP according to an embodiment of the present invention includes a first initialization driver for forming wall charges in cells with a set-up discharge using a set-up signal in a first sub-field and erasing the wall charges with a set-down discharge using a first set-down signal to initialize the cells, and a second initialization driver for erasing the wall charges with a set-down discharge generated using a second set-down signal different from the first set-down signal in a second sub-field, to initialize the cells.

The first and second set-down signals have a ramp waveform whose voltage is gradually decreased.

The absolute value of the lowest voltage of the second set-down signal is higher than the absolute value of the lowest voltage of the first set-down signal.

The gradient of the second set-down signal is larger than that of the first set-down signal.

The first initialization driver provides the set-up signal and the first set-down signal to scan electrodes during a reset period of the first sub-field.

The second initialization driver provides the second set-down signal to the scan electrodes during a reset period of the second sub-field.

The apparatus for driving a PDP further includes an address driver for providing a scan voltage to the scan electrodes and, simultaneously, supplying a data voltage to address electrodes during an address period of the first sub-field, the address driver providing the scan voltage to the scan electrodes and, simultaneously, supplying the data voltage to the address electrodes during an address period of the second sub-field; and a sustain driver for alternately providing a sustain voltage to the scan electrodes and sustain electrodes during a sustain period of each of the first and second sub-fields.

The sustain driver provides a bias voltage to the sustain electrodes during a part of the reset period and the address period in the first and second sub-fields.

The sustain driver provides a first bias voltage to the sustain electrodes while the first set-down signal is supplied to the scan electrodes in the first sub-field; supplies a second bias voltage lower than the first bias voltage to the sustain electrodes during the address period of the first sub-field; provides a third bias voltage lower than the first bias voltage to the sustain electrodes while the second set-down signal is supplied to the scan electrodes in the second sub-field; and supplies a fourth bias voltage higher than the second bias voltage to the sustain electrodes during the address period of the second sub-field.

Hereinafter, preferred embodiments of the present invention will be explained with reference to FIGS. 5, 6, 7 and 8.

Figure 5:
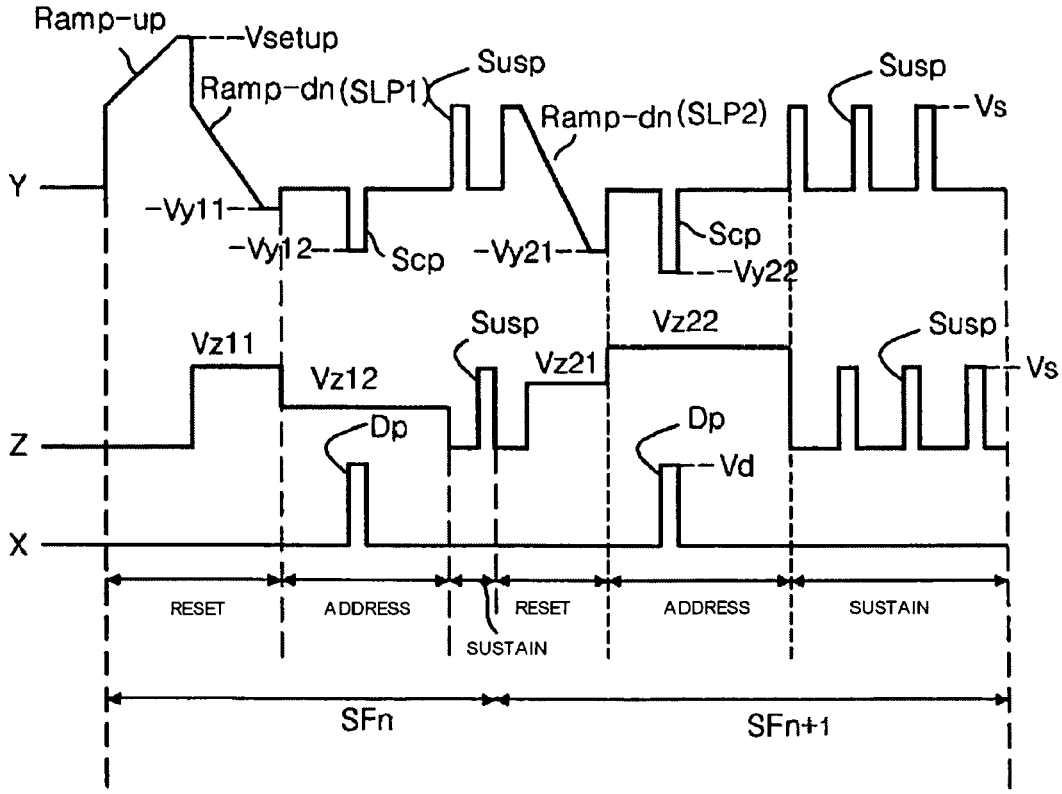
FIG. 5 shows waveforms of driving signals for driving a PDP according to an embodiment of the present invention.

Referring to FIG. 5, a method of driving a PDP according to an embodiment of the present invention uses different driving voltages, required for initialization and addressing, for respective sub-fields.

In the reset period of the nth sub-field SFn, scan electrodes Y are provided with a ramp-up wave Ramp-up having a set-up voltage Vsetup and, simultaneously, sustain electrodes Z and address electrodes X are provided with 0V. The ramp-up wave Ramp-up generates a set-up discharge that barely generates light between adjacent scan electrode Y and address electrode X and between adjacent scan electrode Y and sustain electrode Z in cells of the entire screen of the PDP. Due to this set-up discharge, positive wall charges are accumulated on the address electrodes X and sustain electrodes Z and negative wall charges are accumulated on the scan electrodes Y. A ramp-down wave Ramp-dn(SLP1) following the ramp-up wave Ramp-up is supplied to the scan electrode Y. The voltage of the ramp-down wave Ramp-dn(SLP1) is gradually decreased from a sustain voltage Vs to a first negative voltage Vy11. In synchronization with the ramp-down wave Ramp-dn, a first Z bias voltage Vz11 is provided to the sustain electrodes Z and 0V is supplied to the address electrodes Z. The first Z bias voltage Vz11 can be set to the sustain voltage Vs. When the ramp-down wave Ramp-dn is supplied, a set-down discharge occurs between adjacent scan electrode Y and sustain electrode Z. This set-down discharge erases excessive wall charges unnecessary for an address discharge, among the wall charges generated during the set-up discharge.

In the address period of the nth sub-field SFn, a scan pulse Scp having a second positive voltage Vy12 whose absolute value is higher than that of the first negative voltage Vy11 is sequentially supplied to the scan electrode Y and, simultaneously, a data pulse Dp having a positive data voltage Vd, synchronized with the scan pulse Scp, is provided to the address electrode X. The voltages of the scan pulse Scp and data pulse Dp are added to the wall voltage generated in the reset period, to generate an address discharge in the cells provided with the data pulse Dp. During the address period, the sustain electrodes Z are provided with a second Z bias voltage Vz12 lower than the first Z bias voltage Vz11.

In the sustain period of the nth sub-field, the sustain pulse Susp having the sustain voltage VS is alternately supplied to the scan electrodes Y and sustain electrodes Z. The wall voltage in the cells selected according to the address discharge is added to the sustain voltage Vs to generate a sustain discharge between adjacent scan electrode Y and sustain electrode Z whenever the sustain pulse Susp is supplied.

In the reset period of the (n+1)th sub-field SFn+1, the sustain voltage Vs is supplied to the scan electrodes Y for a predetermined period of time, and then a ramp-down wave Ramp-dn(SLP2) is applied to the scan electrodes Y. The voltage of the ramp-down wave Ramp-dn(SLP2) is gradually decreased from the sustain voltage Vs to a third negative voltage Vy21. Here, the sustain voltage Vs is supplied for a predetermined period of time to generate the sustain discharge in the cells and then the ramp-down wave Ramp-dn (SLP2) generates a set-down discharge. This set-down discharge erases excessive wall charges unnecessary for the address discharge.

During the period of the ramp-down wave Ramp-dn(SLP2) in which the voltage on the sustain electrodes Y is reduced, a third Z bias voltage Vz21 is supplied to the sustain electrodes Z. The third Z bias voltage Vz21 is lower than the first Z bias voltage Vz11.

The absolute value of the third negative voltage Vy21 is higher than that of the first negative voltage Vy11 such that excessive wall charges in the cells can be erased in the (n+1)th sub-field more than in the nth sub-field SFn where a set-down discharge occurs. Furthermore, the gradient of the ramp-down wave Ramp-dn (SLP2) can be larger than the gradient that of the ramp-down wave Ramp-dn (SLP1) of the nth sub-field SFn such that the excessive wall charges in the cells can be erased in the (n+1)th sub-field more than in the nth sub-field SFn where a set-down discharge occurs.

In the address period of the (n+1)th sub-field SFn+1, a scan pulse Scp having a fourth negative voltage Vy22 whose absolute value is higher than that of the third negative voltage Vy21 is sequentially supplied to the scan electrodes Y and, simultaneously, a data pulse Dp having a positive data voltage Vd, synchronized with the scan pulse Scp, is provided to the address electrodes X. The voltages of the scan pulse Scp and data pulse Dp are added to the wall voltage generated in the reset period to generate an address discharge in the cells provided with the data pulse Dp. During this address period, the sustain electrodes Z are provided with a fourth Z bias voltage Vz22 higher than the second Z bias voltage Vz12.

In the sustain period of the (n+1)th sub-field, the sustain pulse Susp having the sustain voltage Vs is alternately supplied to the scan electrodes Y and sustain electrodes Z. The wall voltage in the cells selected according to the address discharge is added to the sustain voltage Vs to generate a sustain discharge between adjacent scan electrode Y and sustain electrode Z whenever the sustain pulse Susp is supplied.

Conditions of driving voltages of the nth and (n+1)th sub-fields SFn and SFn+1 are represented by following expressions.

$$|-Vy11| < |-Vy21| \quad \text{[Expression 1]}$$

$$|-Vy12| < |-Vy22| \quad \text{[Expression 2]}$$

$$Vz11 > Vz21 \quad \text{[Expression 3]}$$

$$Vz12 < Vz22 \quad \text{[Expression 4]}$$

When the above-described conditions of driving voltages are satisfied, the address initial conditions in the nth and (n+1)th sub-fields SFn and SFn+1 becomes identical to each other to widen an address driving margin and stably generate an address discharge. This will now be explained in detail with reference to FIGS. 5 and 6.

The initialization of the nth sub-field SFn is made according to the set-up discharge using the ramp-up wave Ramp-up whose voltage increases to the set-up voltage Vsetup and the set-down discharge using the ramp-down wave Ramp-dn whose voltage decreases to the first negative voltage Vy11, as shown in FIG. 5. During the set-up discharge, negative wall charges are accumulated on the scan electrodes Y and positive wall charges are accumulated on the sustain electrodes Z and address electrodes X due to a write discharge between adjacent scan electrode Y and sustain electrode Z and a write discharge between adjacent scan electrode Y and address electrode Z. During the set-down discharge, excessive wall charges on the electrodes are erased due to an erase discharge between adjacent scan electrode Y and sustain electrode Z and an erase discharge between adjacent scan electrode Y and address electrode Z.

Figure 6:
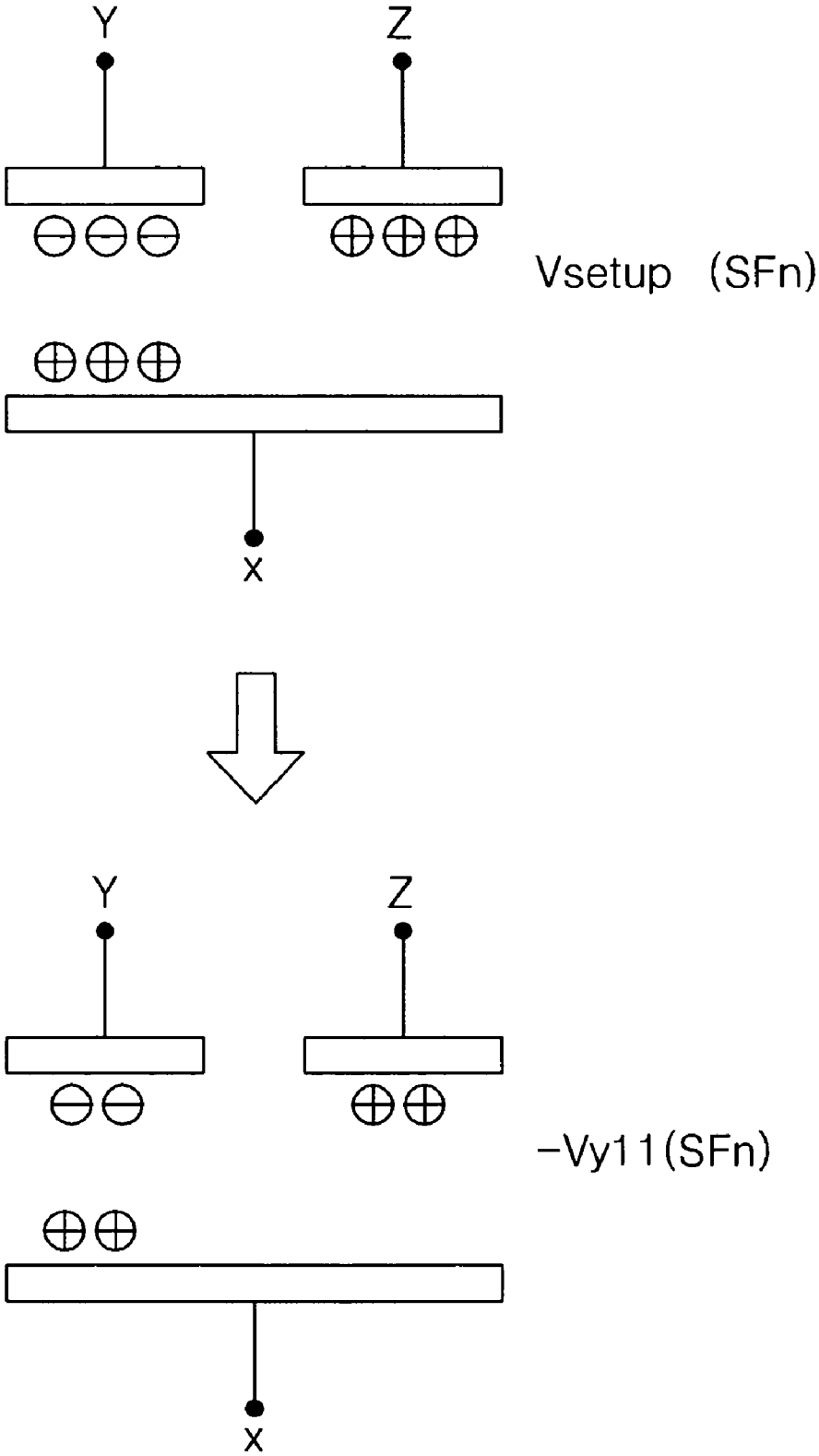
FIG. 6 shows a variation in the distribution of wall charges when cells are initialized using the initialization wave of FIG. 4.
Figure 7:
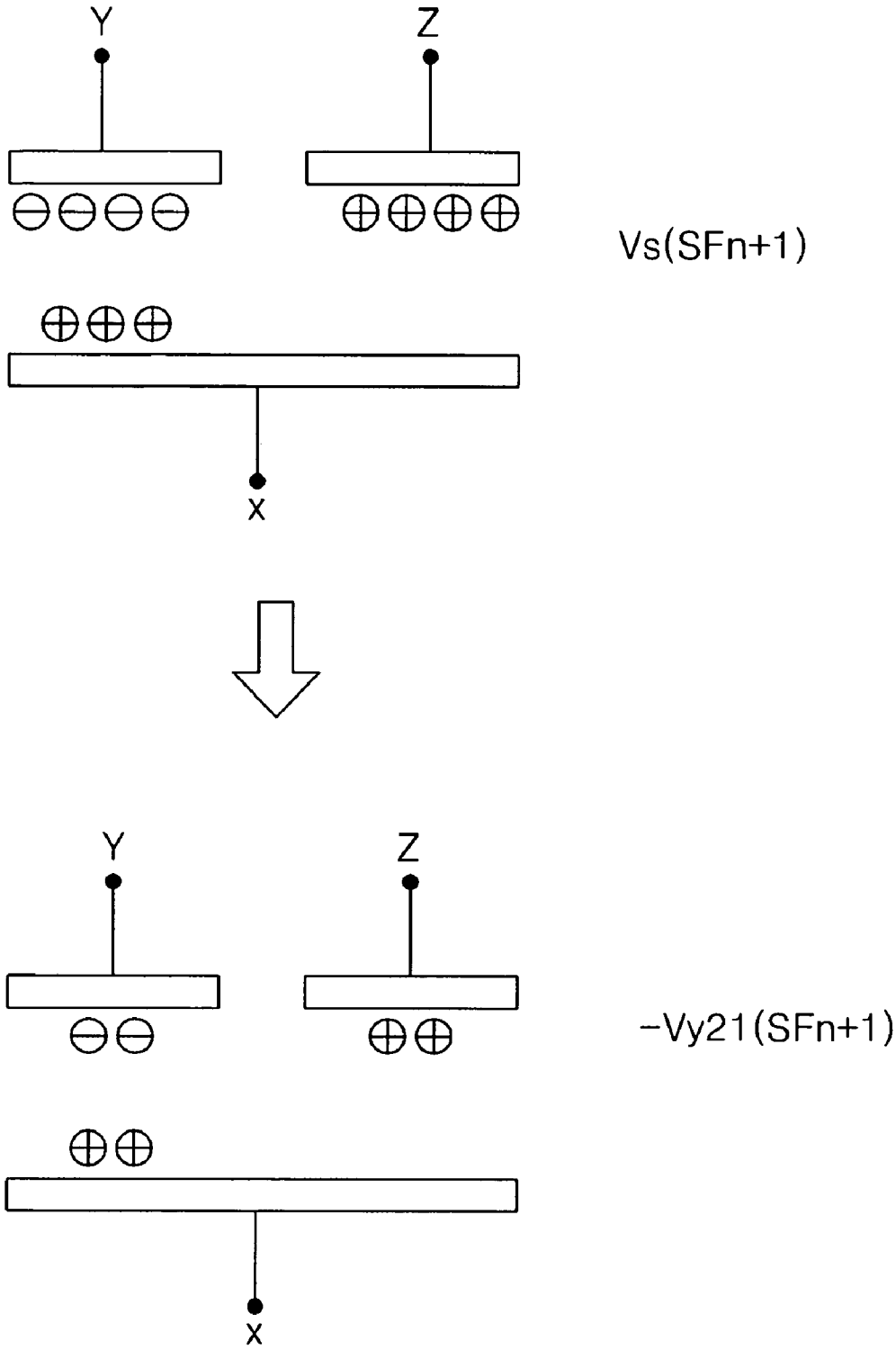
FIG. 7 shows a variation in the distribution of wall charges when cells are initialized using the initialization wave of FIG. 5.

The initialization of the (n+1)th sub-field is made according to a sustain discharge using the last sustain pulse of the sustain voltage Vsetup, followed by the set-down discharge using the ramp-down wave Ramp-dn whose voltage decreases to the third negative voltage Vy21. During the sustain discharge, negative wall charges are accumulated on the scan electrodes Y and positive wall charges are accumulated on the sustain electrodes Z and address electrodes X due to a write discharge between adjacent scan electrode Y and sustain electrode Z and a write discharge between adjacent scan electrode Y and address electrode Z. The quantity of wall charges accumulated during the sustain discharge is larger than the quantity of wall charges accumulated during the set-up discharge as shown in FIGS. 6 and 7. During the set-down discharge of the (n+1)th sub-field SFn+1, an erase discharge occurs more largely due to the ramp-down wave Ramp-dn (SLP2) that is decreased lower than the set-down voltage of the set-down discharge of the nth sub-field SFn, that is, to the third negative voltage Vy21 or has a larger gradient. Thus, wall charges on the electrodes X, Y and Z are erased more than in the nth sub-field SFn where a set-down discharge occurs.

Consequently, the method of driving a PDP according to the present invention can generate a set-down discharge or not in response to whether a set-up discharge occurs or not to make the initialization condition of the sub-field having a set-up discharge identical to that of the sub-field having no set-up discharge, thereby widening the address driving margin.

Figure 8:
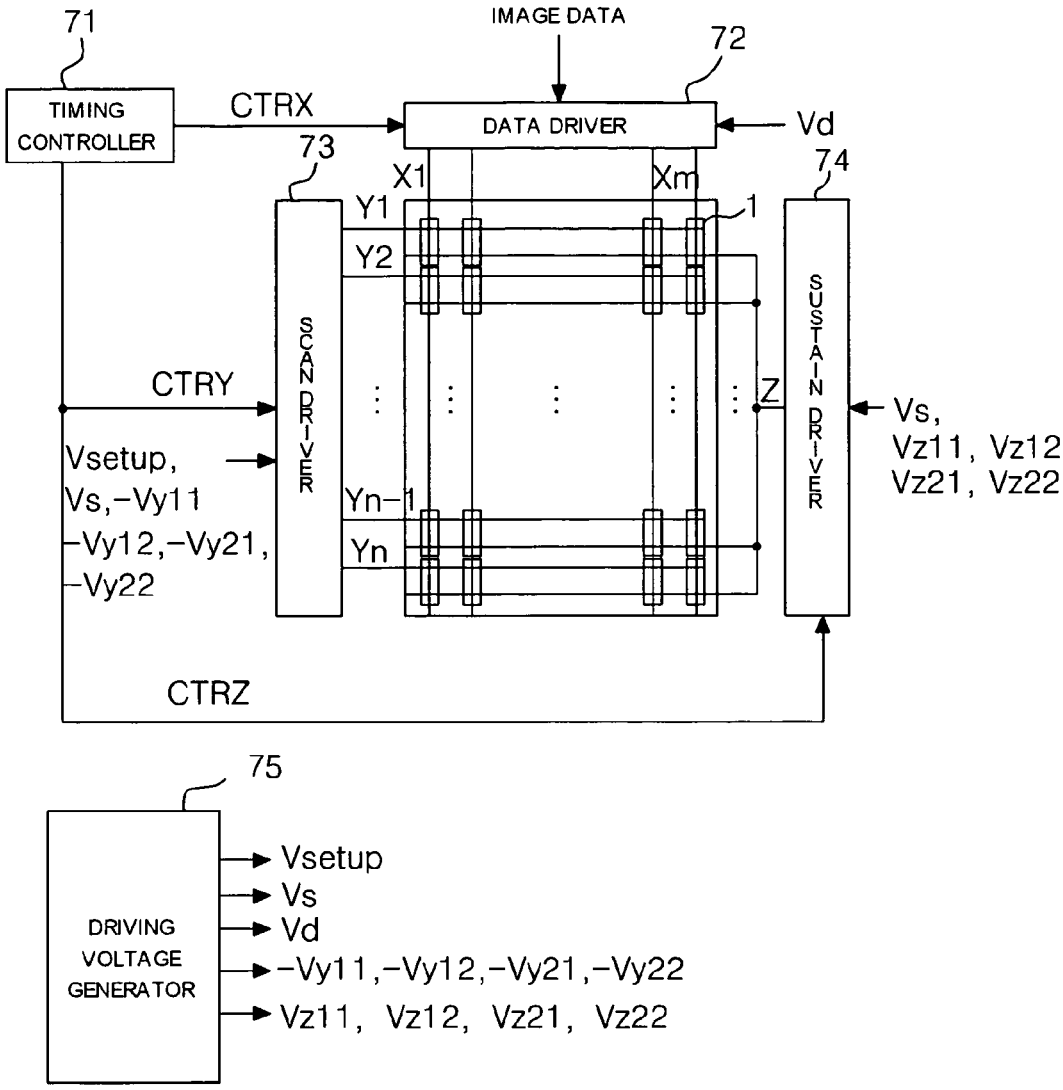
FIG. 8 is a block diagram of an apparatus for driving a PDP according to an embodiment of the present invention.

FIG. 8 is a block diagram of an apparatus for driving a PDP according to an embodiment of the present invention. Referring to FIG. 8, the apparatus for driving a PDP includes a data driver 72 for providing data to the address electrodes X1 to Xm of the PDP, a scan driver 73 for driving the scan electrodes Y1 to Yn, a sustain driver 74 for driving the sustain electrodes Z serving as a common electrode, a timing controller 71 for controlling the drivers 72, 73 and 74, and a driving voltage generator 75 for generating driving voltages required for the drivers 72, 73 and 74.

The data driver 72 is provided with data that has been subjected to inverse gamma correction and error diffusion carried out by an inverse gamma correction circuit and an error diffusion circuit (not shown) and then mapped to each sub-field by a sub-field mapping circuit. The data driver 72 samples and latches the data in response to a timing control signal CTRX derived from the timing controller 71 and then provides the data to the address electrodes X1 to Xm.

The scan driver 73 provides the ramp-up wave Ramp-up and ramp-down wave Ramp-dn to the scan electrodes Y1 to Yn during the reset period of the nth sub-field SFn and supplies the sustain voltage Vs and ramp-down wave Ramp-dn to the scan electrodes Y1 to Yn during the reset period of the (n+1)th sub-field SFn+1 under the control of the timing controller 71. Furthermore, the scan driver 73 sequentially provides the scan pulse Scp having the scan voltage Vy to the scan electrodes Y1 to Yn during the address period of each sub-field and supplies the sustain pulse Susp to the scan electrodes Y1 to Yn during the sustain period under the control of the timing controller 71.

The sustain driver 74 provides the first and second Z bias voltages Vz11 and Vz12 to the sustain electrodes Z during the period in which the ramp-down wave Ramp-dn(SLP1) is generated and the address period of the nth sub-field SFn and supplies the third and fourth Z bias voltages Vz21 and Vz22 to the sustain electrodes Z during the period in which the ramp-down wave Ramp-dn(SLP2) is generated and the address period of the (n+1)th sub-field SFn+1 under the control of the timing controller 71. Furthermore, the sustain driver 74 and scan driver 73 are alternately operated during the sustain period of each sub-field to provide the sustain pulse Susp to the sustain electrodes Z under the control of the timing controller 71.

The timing controller 71 receives vertical/horizontal synchronous signals and a clock signal, generates timing control signals CTRX, CTRY and CTRZ for controlling operating timing and synchronization of the drivers 72, 73 and 74, and provides the timing control signals CTRX, CTRY and CTRZ to corresponding drivers 72, 73 and 74 to control them. The data control signal CTRX includes a sampling clock signal for sampling data, a latch control signal and a switch control signal for controlling on/off time of an energy collecting circuit and a driving switch. The scan control signal CTRY includes a switch control signal for controlling on/off time of an energy collecting circuit and a driving switch in the scan driver 73. The sustain control signal CTRZ includes a switch control signal for controlling on/off time of an energy collecting circuit and a driving switch in the sustain driver 74.

The driving voltage generator 75 generates the set-up voltage Vsetup, negative voltages Vy11, −Vy12, −Vy21 and Vy22, sustain voltage Vs, data voltage Vd, and Z bias voltages Vz11, Vz12, Vz21 and Vz22. These driving voltages can be varied with the composition of discharge gas, discharge cell structure or surrounding temperature of PDP.

In the meantime, the method and apparatus for driving a PDP according to the present invention can vary the negative voltages Vy11, −Vy12, −Vy21 and Vy22 or Z bias voltages Vz11, Vz12, Vz21 and Vz22 in response to an average picture level of an input image, data load or surrounding temperature.

The method and apparatus for driving a PDP according to the present invention divide one frame into at least one sub-field where a set-up discharge occurs and at least one sub-field where the set-up discharge does not occur to display images. The present invention uniformly initializes the sub-fields to widen the driving margin of PDP and removes a set-up discharge in at least one sub-field to improve the contrast of PDP.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A method for driving a PDP comprising:

a first step of forming wall charges in cells with a set-up discharge using a set-up signal in a first sub-field and erasing the wall charges with a set-down discharge using a first set-down signal to initialize the cells, wherein the first set-down signal has a first gradient; and a second step of erasing the wall charges with a set-down discharge generated using a second set-down signal in a second sub-field, to initialize the cells, wherein the second set-down signal has a second gradient different from the first gradient of the first set-down and an end voltage of the second ramp-down waveform is different from an end voltage of the first ramp-down waveform.

2. The method as claimed in claim 1, wherein the first and second set-down signals have a ramp waveform whose voltage is gradually decreased.

3. The method as claimed in claim 2, wherein the absolute value of the lowest voltage of the second set-down signal is higher than the absolute value of the lowest voltage of the first set-down signal.

4. The method as claimed in claim 2, wherein the second gradient of the second set-down signal is larger than the first gradient of the first set-down signal.

5. The method as claimed in claim 1, wherein the first step provides the set-up signal and the first set-down signal to scan electrodes during a reset period of the first sub-field.

6. The method as claimed in claim 5, wherein the second step provides the second set-down signal to the scan electrodes during a reset period of the second sub-field.

7. The method as claimed in claim 6, further comprising the steps of: providing a scan voltage to the scan electrodes and, simultaneously, supplying a data voltage to address electrodes during an address period of the first sub-field;

alternately providing a sustain voltage to the scan electrodes and sustain electrodes during a sustain period of the first sub-field;

providing the scan voltage to the scan electrodes and, simultaneously, supplying the data voltage to the address electrodes during an address period of the second sub-field; and alternately providing the sustain voltage to the scan electrodes and sustain electrodes during a sustain period of the second sub-field.

8. The method as claimed in claim 7, further comprising the steps of:

providing a first bias voltage to the sustain electrodes while the first set-down signal is supplied to the scan electrodes in the first sub-field;

supplying a second bias voltage lower than the first bias voltage to the sustain electrodes during the address period of the first sub-field;

providing a third bias voltage lower than the first bias voltage to the sustain electrodes while the second set-down signal is supplied to the scan electrodes in the second sub-field; and supplying a fourth bias voltage higher than the second bias voltage to the sustain electrodes during the address period of the second sub-field.

9. An apparatus for driving a PDP comprising:

an initialization driver that provides a first initialization driver signal for forming wall charges in cells with a set-up discharge using a set-up signal in a first sub-field and erasing the wall charges with a set-down discharge using a first set-down signal to initialize the cells, wherein a lowest voltage of the first set-down signal is a first voltage; and a second initialization driver signal for erasing the wall charges with a set-down discharge generated using a second set-down signal in a second sub-field, to initialize the cells, wherein a lowest voltage of the second set-down signal is a second voltage different than the first voltage of the first set-down signal and an end voltage of the second ramp-down waveform is different from an end voltage of the first ramp-down waveform.

10. The apparatus as claimed in claim 9, wherein the first and second set-down signals have a ramp waveform whose voltage is gradually decreased.

11. The apparatus as claimed in claim 10, wherein the absolute value of the second lowest voltage of the second set-down signal is higher than the absolute value of the first lowest voltage of the first set-down signal.

12. The apparatus as claimed in claim 10, wherein the gradient of the second set-down signal is larger than that of the first set-down signal.

13. The apparatus as claimed in claim 9, wherein the first initialization driver provides the set-up signal and the first set-down signal to scan electrodes during a reset period of the first sub-field.

14. The apparatus as claimed in claim 13, wherein the second initialization driver provides the second set-down signal to the scan electrodes during a reset period of the second sub-field.

15. The apparatus as claimed in claim 9, further comprising:

an address driver for providing a scan voltage to the scan electrodes and, simultaneously, supplying a data voltage to address electrodes during an address period of the first sub-field, the address driver providing the scan voltage to the scan electrodes and, simultaneously, supplying the data voltage to the address electrodes during an address period of the second sub-field; and a sustain driver for alternately providing a sustain voltage to the scan electrodes and sustain electrodes during a sustain period of each of the first and second sub-fields.

16. The apparatus as claimed in claim 15, wherein the sustain driver provides a bias voltage to the sustain electrodes during a part of the reset period and the address period in the first and second sub-fields.

17. The apparatus as claimed in claim 16, wherein the sustain driver provides a first bias voltage to the sustain electrodes while the first set-down signal is supplied to the scan electrodes in the first sub-field; supplies a second bias voltage lower than the first bias voltage to the sustain electrodes during the address period of the first sub-field; provides a third bias voltage lower than the first bias voltage to the sustain electrodes while the second set-down signal is supplied to the scan electrodes in the second sub-field; and supplies a fourth bias voltage higher than the second bias voltage to the sustain electrodes during the address period of the second sub-field.

* * * * *